United States Patent [19]

Odle et al.

[11] 4,451,875

[45] May 29, 1984

[54] POSTER PANEL LIGHTING FIXTURE

[75] Inventors: Herbert A. Odle; John D. Green; Jan Shadwick, all of Newark, Ohio

[73] Assignee: Manville Service Corporation, Denver, Colo.

[21] Appl. No.: 353,997

[22] Filed: Mar. 2, 1982

[51] Int. Cl.[3] ..... F21V 7/00

[52] U.S. Cl. ..... 362/297; 362/145; 362/304; 362/305; 362/308; 362/309; 362/328; 362/329; 362/337; 362/338; 362/339; 362/340; 362/346; 362/348; 362/812; 40/560

[58] Field of Search ..... 362/145, 812, 297, 304, 362/305, 308, 309, 328, 329, 336, 337, 338, 339, 390, 396, 398; D20/39; 40/541, 559, 560

[56] References Cited

U.S. PATENT DOCUMENTS

| | | | |
|---|---|---|---|
| 3,329,812 | 7/1967 | Harling | 362/309 |
| 4,234,912 | 11/1980 | Barnes et al. | 362/145 |
| 4,263,641 | 4/1981 | Ferrero | 362/309 |

*Primary Examiner*—Stephen J. Lechert, Jr.

*Attorney, Agent, or Firm*—Ronald M. Halvorsen; Cornelius P. Quinn

[57] ABSTRACT

A single lighting fixture for mounting in front of a large billboard having a horizontal length approximately two times as long as its vertical length is disclosed. The lighting fixture comprises a lamp housing having a lamp positioned therein with the lamp being approximately horizontally positioned in the housing. A new and novel reflector is positioned on one side of the lamp is designed to reflect the light radiating from the lamp in such a manner that the bottom surface of the reflector is utilized to light up the approximate central portion of the billboard while the sides of the reflector are used to light triangular shaped side corners of the billboard. A refractor is positioned on the lamp housing to totally enclose the lamp with the refractor comprising in part three phase light control prism elements for stray light control. The combination of the reflector and refractor is designed so as to illuminate the opposite adjacent corners of the billboard with approximately 80% of the light quantity illuminating approximately 30% of the billboard corners and approximately 20% of the light quantity illuminating 70% of the edge of the billboard.

9 Claims, 13 Drawing Figures

10
9
9
54
10
10
46
44
18
64
40
30
36
42
32
48
50
52
62
56
34
58
16
60
LC

POSTER PANEL LIGHTING FIXTURE

BACKGROUND OF THE INVENTION

This invention relates generally to a lighting fixture and more particularly to a new and novel outdoor lighting fixture for use in illuminating a large poster panel such as an outdoor advertising billboard sign of the type that is generally 12' high and 24' long.

In the illumination of poster panels such as outdoor advertising signs, prior art illumination would be accomplished by a pair of eight foot long flourescent units positioned end-to-end either below or above the panel. Other types of prior art lighting would include a grouping of single incandescent units positioned along the top or bottom edges of the panel. With the advent of energy conservation, it is highly desirable to be able to light outdoor billboard signs such as before mentioned with the use of a single luminaire using a concentrated high intensity discharge light source such as 250 watt metal halide lamp.

The use of existing high intensity discharge luminaires to light poster panels having a horizontal length approximately two times as long as its vertical length resulted in deficiency in the light which was positioned on the bottom corners of the uprightly positioned poster panel. The central portion of the panel was able to be lighted by the prior art type devices but the generally triangular shaped lower corner edges of the panel required special consideration in order to be able to obtain a uniformity of illumination throughout the poster panel when lighted with a single centrally positioned bottom luminaire. The triangular shaped dark corner areas in the lower corner of the panel resulted from positioning of the lighting fixture at the lower central portion of the panel and it is clear that with the lighting fixture positioned at the upper central portion of the panel, the same problem of lighting the corner area would be present with the exception that the triangular shaped corners would appear in the upper right and left corner of the outdoor advertising sign.

SUMMARY OF THE INVENTION

In order to overcome problems inherent in the use of the before described prior art fixtures, there has been provided by the subject invention a new and novel single lighting fixture designed for mounting in front of a large outdoor advertising panel. The fixture is capable of providing uniform illumination across the entire panel length even when the panel has a horizontal length approximately two times as long as its vertical length. The new and novel lighting fixture may be mounted in the central portion of the advertising sign either above or below the sign as hereinafter described.

The new and novel lighting fixture comprises a generally horizontally positioned lamp contained within a lamp housing which is mounted on the outside of the advertising sign. The housing contains a lamp energized by known means for lighting the lamp and also contains a reflector which is positioned on one side of the lamp and is designed to reflect the light radiating from the lamp. The reflector has a first generally linearly translated parabolic surface and further has two side surfaces formed parabolic in one direction through a horizontal section of the side surface. A refractor is positioned over the lamp in the lamp housing to totally enclose the lamp from outside weather elements and the refractor comprises in part a combination of prism elements which are designed for three phase light control of stray light. The three phase light control permits a refraction, a reflection and finally a refraction of the stray light radiating from the lamp. With the Applicant's new and novel combination hereinafter described the unit is able to illuminate the opposite adjacent corners of the billboard to provide a much more uniform light distribution pattern over the entire elongated billboard surface than has been heretofor possible with prior art devices.

Accordingly it is an object advantage of the invention to provide a new and novel single lighting fixture capable of use for lighting an outdoor advertising panel and which provides more uniform light distribution over the entire panel surface by directing major portions of the light from the luminaire onto selected areas of the panel which previously had been hard to light using a single fixture.

Yet another object and advantage of the invention is to provide a simple lighting fixture which is capable of being used as a single fixture and is capable of being positioned in the upper or lower area of a billboard with the fixture combining a new and novel reflector and refractor for directing the light in pre-determined manners to achieve more uniform illumination over the panel.

These and other objects and advantages of the invention will become apparent from a review of the specification and from a study of the drawings which show the preferred embodiment of the invention by way of illustration only.

BRIEF DESCRIPTION OF THE DRAWINGS

FIG. 9 is a plan view, taken along 9—9 of FIG. 3 showing a half view the Applicant's new and novel refractor removed from the housing fixture and showing the arrangement of the various prism elements on the inside of the refractor;

DESCRIPTION OF THE PREFERRED EMBODIMENT

Figure 1:
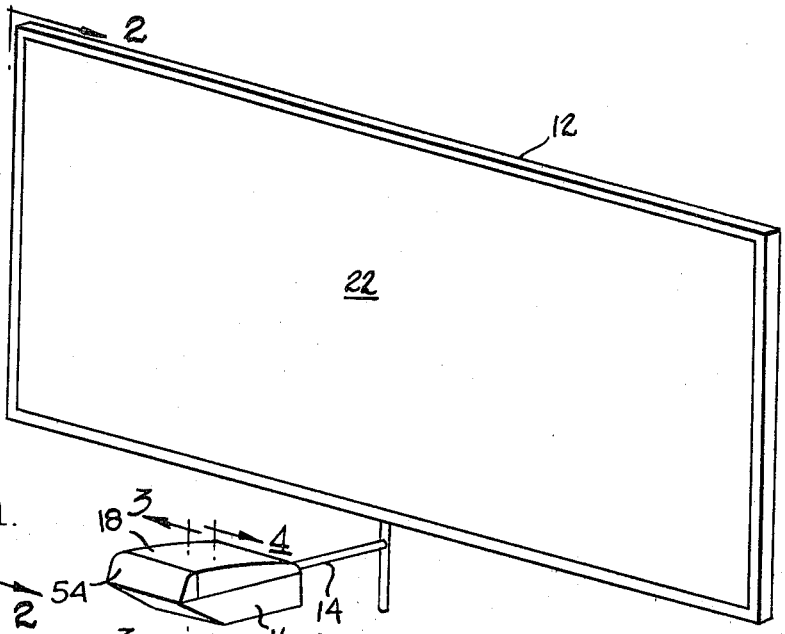
FIG. 1 is a perspective view of the Applicant's single lighting fixture showing it mounted on the lower central portion of an outdoor advertising panel having a horizontal length approximately two times as long as its vertical height.
Figure 2:
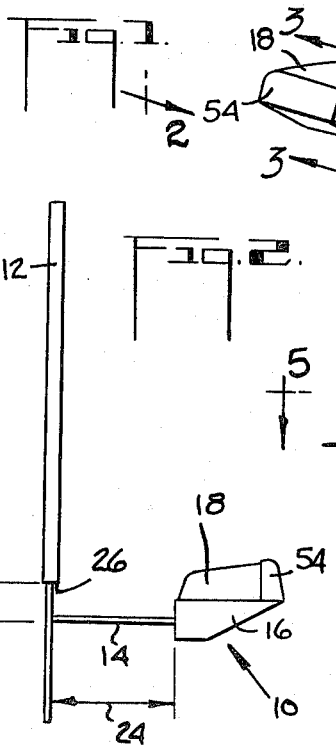
FIG. 2 is a side view, taken along line 2—2 of FIG. 1 showing the positioning of the lighting fixture shown in FIG. 1 mounted somewhat lower than the bottom edge of the billboard panel.

Referring now to the drawings in general and in particular to FIGS. 1 and 2 of the drawings there is shown the Applicant's new and novel lighting fixture, shown generally by the numeral 10, as it is fastened to a outdoor billboard 12 by means of a pipe 14 or some other fastening device. The lighting fixture comprises a lamp housing 16 formed as shown in the figures and having a refractor 18 in position on the housing 16 in such a manner to totally enclose the lamp 20 contained within the housing 16.

The lighting fixture 10 may be mounted in the position shown in FIG. 1 and may also be mounted on the upper portion of the billboard 12 in the central area in a manner similar shown in the mounting shown in FIG. 1. The area to be lighted by the lamp 20 would include the entire surface 22 shown in FIG. 1 in as uniform a manner as possible without eye disturbing lighting contrasts in the various areas of the panel. In positioning the lighting fixture 10 it has been found from experimentation that it would be preferably positioned between $3\frac{1}{2}$–4′ from the billboard as shown by the arrow 24 and also would be preferably positioned approximately 1′ below the billboard edge 26 as shown by the arrow 28. When positioned thusly it has been found that the area to be lighted 22 would have a much more uniform illumination thereby providing a more pleasant eye appealing advertising sign placed on the surface area 22.

Figure 3:
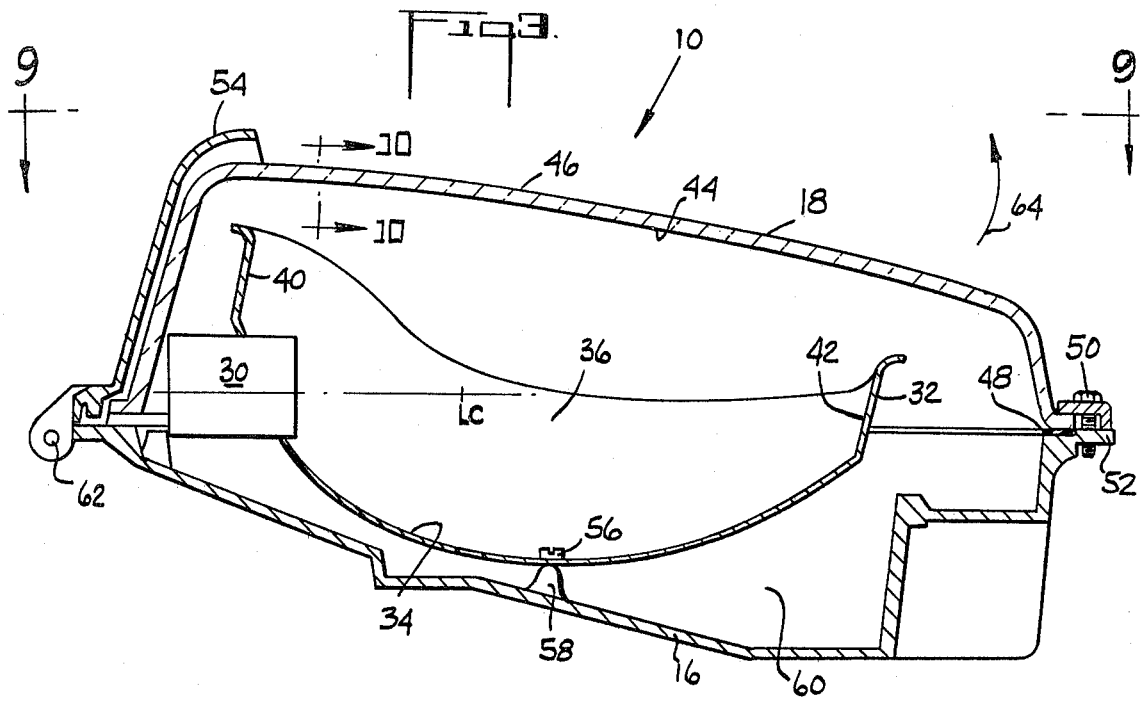
FIG. 3 is a cross sectional view, taken along line 3—3 of FIG. 1, through the lamp housing showing the positioning of the lamp socket in relation to the reflector and also showing the position of the reflector mounted in the housing and the refractor positioned over the reflector to totally enclose the lamp structure.

Referring now to FIG. 3 of the drawing there is shown in detail, a cross sectional view, taken along 3—3 of the FIG. 1, showing the interior of the Applicant's lighting fixture 10. As before mentioned a lamp 20 is positioned in a lamp socket 30 so as to be approximately horizontally positioned within the lamp housing 16. For purposes of clarity, the lamp 20 is not shown in FIG. 3 and also the means for lighting the lamp such as the associated wiring and power necessary for the high intensity discharge type lamp is not shown.

A reflector 32 is positioned on one side of the lamp and is designed to reflect the light radiating from the lamp hereinafter described. The reflector 32 has a first generally linear translated parabolic bottom surface 34 and has two side surfaces 36 and 38 which are formed parabolic in one direction through a horizontal section of the side surface. The generally linear parabolic bottom surface 34 is formed in the configuration shown in FIG. 3 and also comprises the substantially parallel end surfaces 40 and 42 shown in FIG. 3 and also more clearly in FIG. 5 of the drawing.

As has been before mentioned, a refractor 18 is positioned on the lamp housing 16 to totally enclose the lamp 20 from outside weather elements. The refractor 18 comprises a combination of prism elements to be described more fully hereinafter which are designed for three phase light control of stray light. The refractor 18 is designed to refract, reflect and finally to refract the stray light radiating from the lamp 20. In the formation of the refractor 18 it is preferably made so that the prism elements are formed on the inside surface 44 of the refractor with the outside surface 46 being formed relatively smooth in order to allow the refractor 18 to be self cleaning. The refractor 18 is positioned within the lamp housing 16 and is held in place on a gasket 48 by means of a plurality of bolts 50 through a plurality tapped holes formed in the flange 52 of the housing 16. The housing 16 also contains a shield 54 which is designed to partially enclose the refractor 18 and to shield stray light from the rear portion of the refractor which will not be able to be redirected by the refractor prisms. The reflector 32 is fixedly held inside the lamp housing 16 by means of a screw 56 tapped in a boss 58 on the inside area 60 of the lamp housing 16.

The entire refractor 18 along with the shield 54 is capable of being pivoted upwardly about the pins 62 whenever it is desirous of having access to the inside of the lamp housing. By removing the bolts 50 it can be seen that the refractor 18 and the shield 54 may be pivoted upwardly in the direction shown by the arrow 64 to provide the interior access to the lighting fixture.

Figure 4:
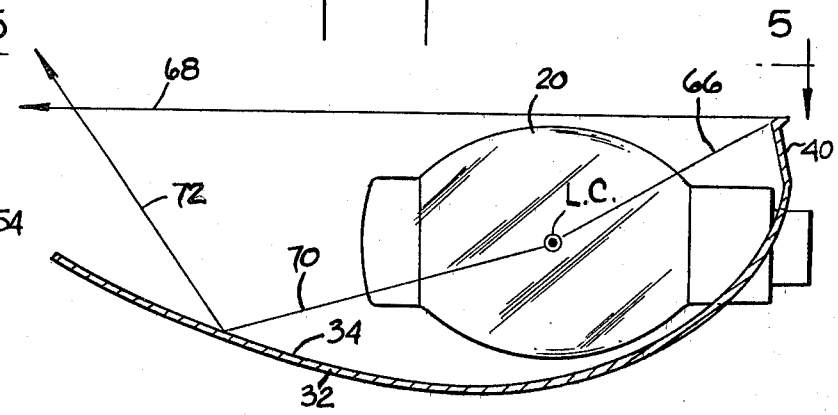
FIG. 4 is a partial cross sectional view, taken along line 4—4 of FIG. 1 showing a lamp positioned in the lamp socket and further showing the relationship of the rays from the lamp and how they are reflected from the reflector surface.
Figure 5:
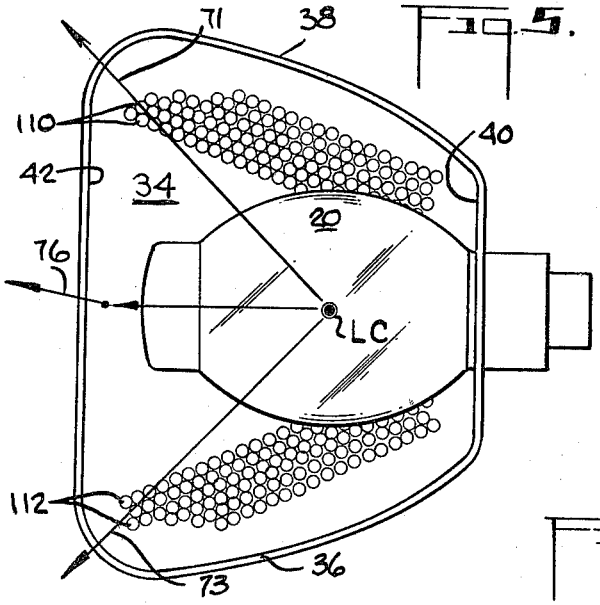
FIG. 5 is a plan view, taken along 5—5 of FIG. 4 showing the total contour of the reflector surface and in particular showing the two side surfaces of the reflector.

Referring now to FIG. 4 and FIG. 5 of the drawings there is shown positioned inside the reflector 32 the lamp 20 and showing how the various rays of the lamp are controlled to light various portions of the billboard panel. It can be seen in FIG. 4 how a ray 66 would be reflected off the end surface 40 in the direction shown by the arrow 68 to light the bottom of the poster panel. In a similar manner a forward directed light ray 70 would be reflected off the bottom surface 34 to be directed upwardly in the direction of the arrow 72 to light the top of the poster panel.

It can be seen in FIG. 5 how a light ray 71 and 73 would be directed to the extreme top corners of the poster panel and how a centrally positioned ray 76 would be directed to light the center line area of the poster panel from top to the bottom.

Figure 6:
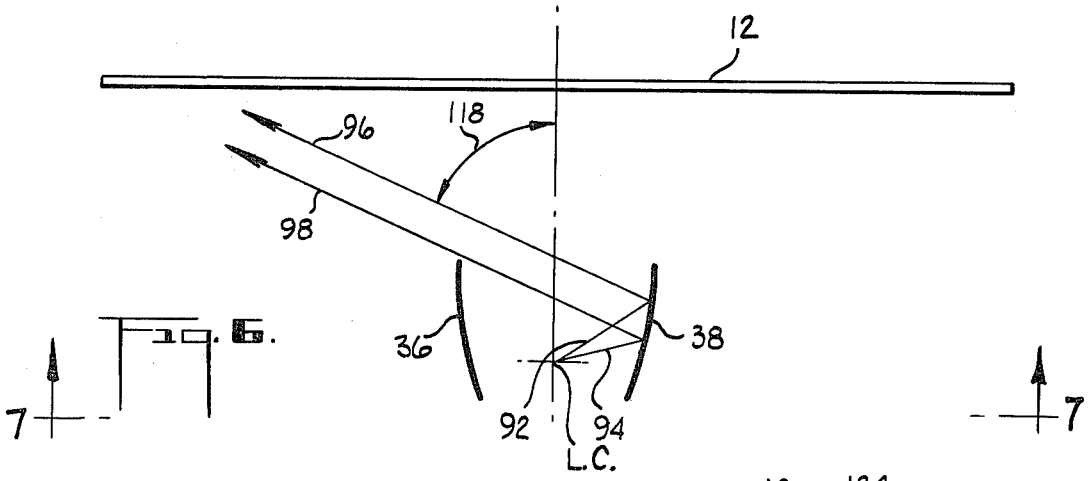
FIG. 6 is a plan view of the reflector sides showing them positioned in front of the billboard, showing how one side of the reflector is used to control the light rays from the lamp onto the billboard opposite edges.
Figure 7:
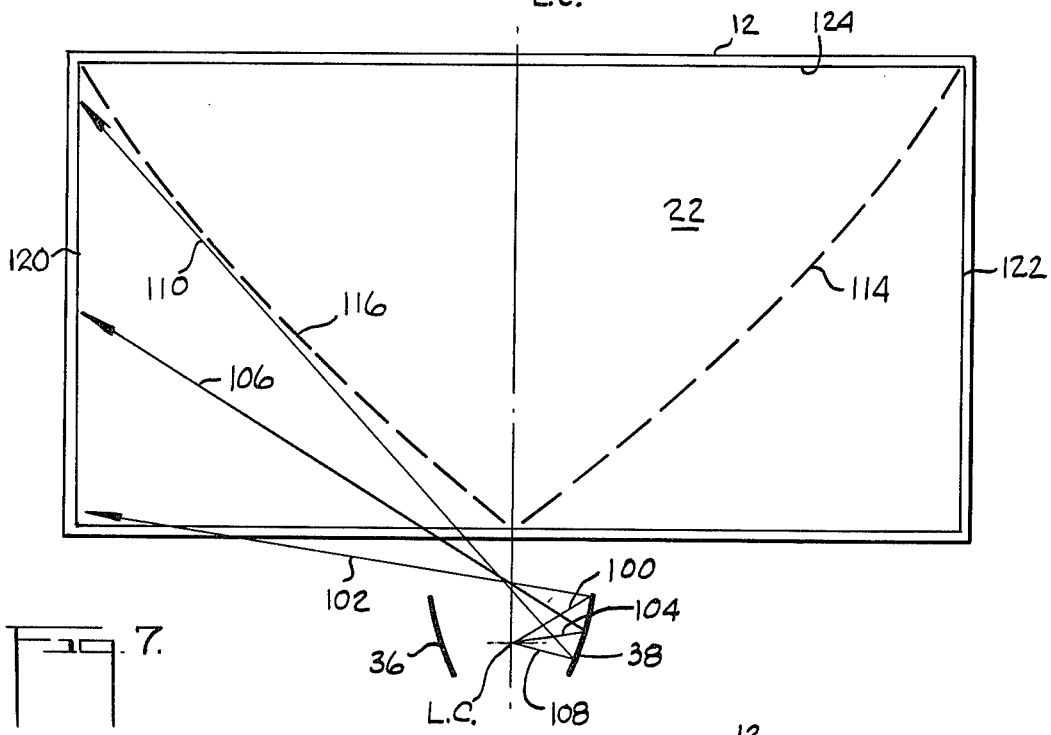
FIG. 7 is an end view, taken along line 7—7 of FIG. 6 showing also the side surfaces of the Applicant's reflector and how they are utilized to control the light to the outer edges of the billboard.
Figure 8:
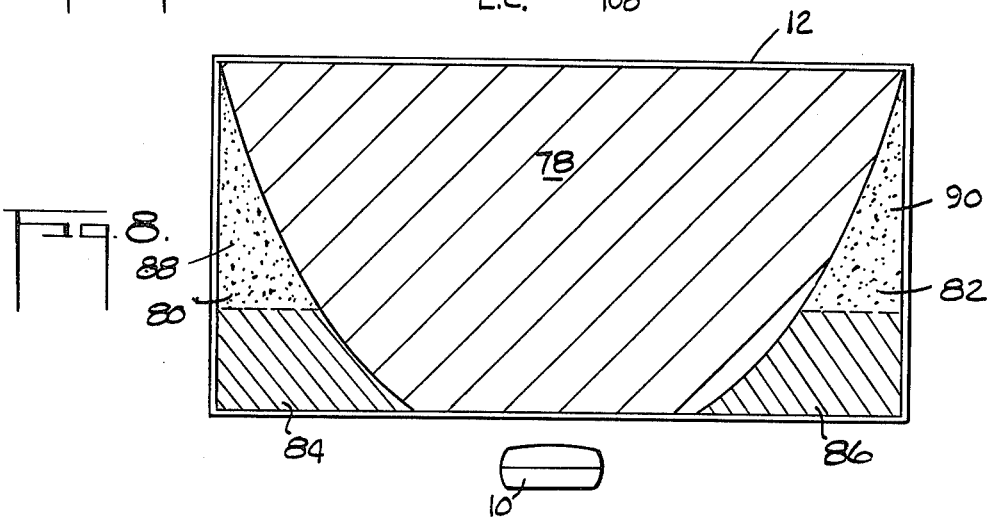
FIG. 8 is a side view of a billboard of the type having a horizontal length approximately two times as long as its vertical height and showing the areas in the billboard which are capable of being lighted by prior art devices and showing the areas in the corners of the billboard which the Applicant's device is also capable of providing more uniform lighting.
Figure 8:
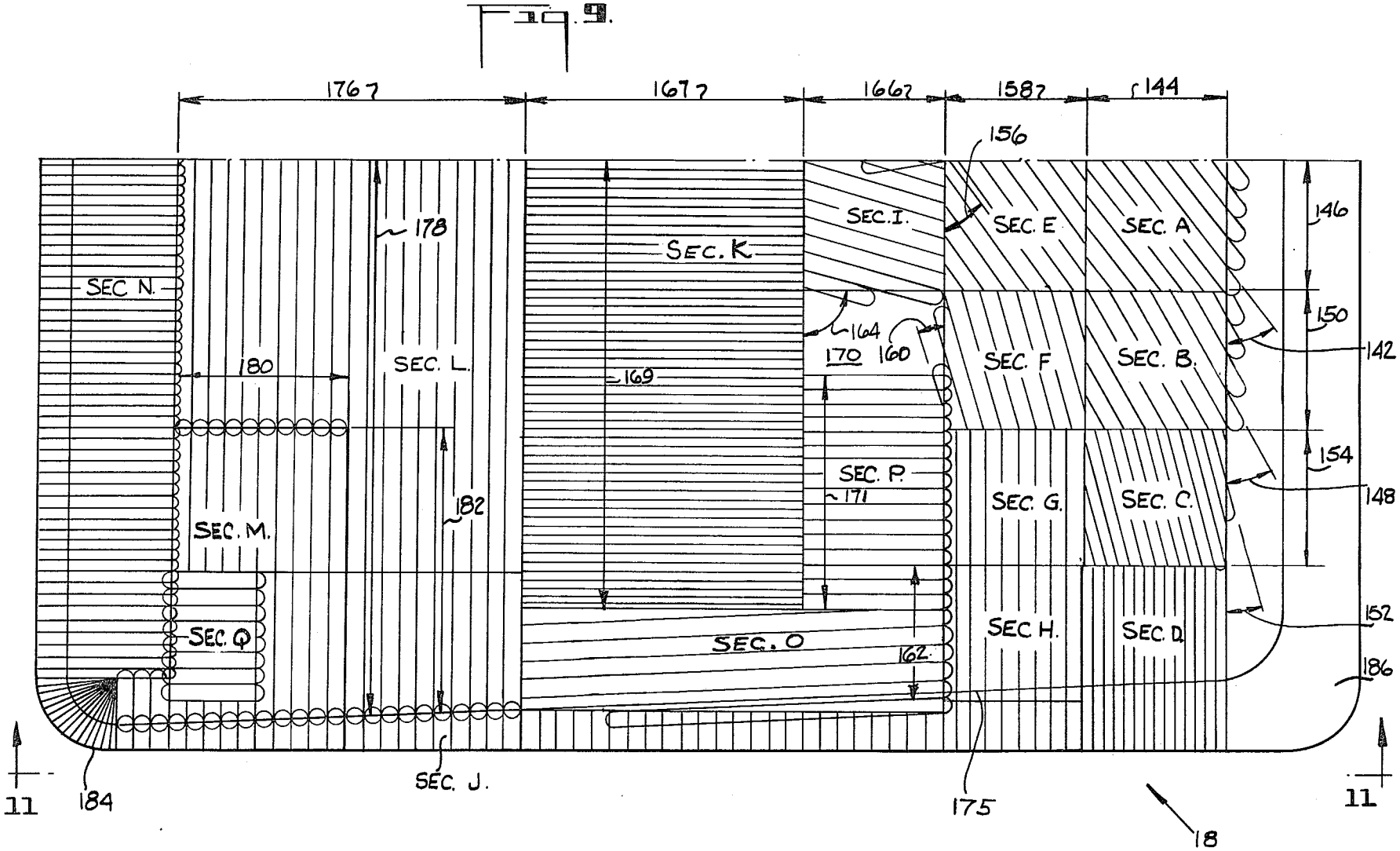

Referring now to FIGS. 6, 7 and 8 there will be shown in more detail how the edges of the poster panel are lighted and more particularly how the triangularly shaped corner areas of the panel are lighted. In FIG. 8 there is shown a side view of the surface area 22 to be lighted. The cross section area 78 shown in FIG. 8 is the approximate area which is lighted by the bottom surface 34 of the Applicant's reflector 32 and represents the area that prior art type of reflector lights were capable of lighting. The triangular shaped areas 80, 82, 84 and 86 represent the areas which are lighted by side surfaces 36 and 38 of the Applicant's reflector 32.

Referring now more specifically to FIGS. 6 and 7, there can be seen how the reflector side surfaces 36 and 38 are utilized to accomplish the lighting of the corner areas. In FIG. 6 there can be seen the plan view showing the side surfaces 36 and 38 and how they are utilized to direct the rays 92 and 94 in the direction shown by the arrows 96 and 98 to the left corner edges of the billboard 12. For purposes of clarity the rays directed to the side surface 36 have not been shown in FIG. 6 and it should become apparent that the side surface 36 would direct light rays to the right edges of the billboard 12.

It can be seen in FIG. 7, which is an end view of the Applicant's lighted billboard showing the positioning of the side surfaces 36 and 38 how the ray 100 from the lamp 20 would be directed against the sides of the side surface 38 of the reflector 32 to be redirected in the direction shown by the arrow 102. In a similar manner the ray 104 would be redirected to light the central portions of the edges of the billboard in the direction of the arrow 106. The ray 108 would be redirected by the side surface 38 in the direction by the arrow 110 to illuminate the upper portion of the triangular edges of the billboard. In a similar manner, the left side surface 36 would be used to redirect the rays from the lamp 20 to light the right side of the billboard 12.

It has also been found to be desirable to provide a plurality of bumps 110 and 112 in radial areas of the bottom surface 34 of the reflector 32. The bumps 110 and 112 may be utilized to eliminate radial streaks 114 and 116 which are shown in FIG. 7 of the drawing by the dashed lines. The bumps 110 and 112, shown in FIG. 5 of the drawing would be formed by truncated spheres having a $+10°$ or $-10°$ slope upwardly and would be formed as upward positioned bumps which provide a $+20°$ or $-20°$ light dispersion on each side of the radial streak area 114 and 116 to thereby eliminate the radial streak.

In designing the reflector 32 it is designed such that any horizontal plane passing through the end surfaces 40 and 42 will yield an intersection approximating a parabola with its focus at the light center (L. C.) and its axis pointing towards the edge of the billboard sign on the end of the billboard sign opposite the reflector end. In other words, a cross-over occurs and this is illustrated in FIG. 6 of the drawing by the angle shown by the arrow 118 which would be approximately 66° when the housing is positioned as hereinbefore described. The vertical distribution of the light along the edges 120 and 122 of the billboard sign is accomplished through the curvature of the reflector 32 in its vertical planes. The top edge of the vertical planes directs the light to the bottom corners of the sign and the bottom edge of the reflector sections directs the light to the top edge 124 of the billboard sign. Approximately 30% of the vertical section is devoted to lighting the bottom corners of the sides since this area is the hardest to light due to light having to exit glass at extremely high angles of incidence and due to physical restrictions often not permitting the light to get there from a mechanical constraint standpoint. The remainder of the side panel areas representing 70% of said side panels are designed to evenly light the entire height of the edge of the sign.

The bottom boundary of the reflector side surfaces 36 and 38 is determined by the design of the bottom surface 34 and end surfaces 40 and 42 of the bottom surface 34. The top boundary is contoured to prevent interference with direct and reflected light which is utilized on the sign surface 22.

Figure 10:
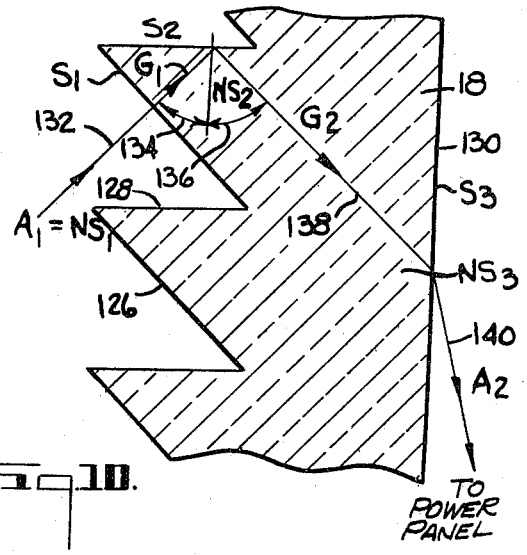
FIG. 10 is a sectional view, taken through line 10—10 of FIG. 3, showing the three phase light control of the Applicant's invention for controlling the stray light by the use of the refractor as will be more fully described hereinafter.

Referring now to FIGS. 9 and 10 of the drawing there will be described in more detail the novel refractor 18 of the Applicant's invention. The refractor 18 is designed with a combination of prism elements which are designed for three phase light control of stray light to redirect the stray light to the billboard panel. The refractor 18 could be considered an optical component of the luminaire whereby its use, the luminous flux from the light source and, in some cases from the reflector, is redirected in varying amounts to achieve a final high degree of uniformity of illumination on the poster panel. As is before mentioned, the outside surface 46 of the refractor 18 has been formed relatively smooth so that it would be totally self cleaning. The inside surface 44 of the refractor 18 is then devoted to the optical control desired. Sections of the refractor may be left plain where directed light is not desired or required. Referring to FIG. 10 of the drawing, there is shown a cross sectional view taken along line 10—10 of FIG. 3 showing the three phase light control by the use of the various prism elements of the refractor 18. In designing the overall configuration of the refractor 18, the entire surface of the refractor was broken into squares and the light going through each square was analyzed and if needed was redirected by order of the various prisms on the inside surface of the refractor. It should be noted that not only the cross sectional shape of the prisms is important but the direction or the path of the prisms becomes important in the overall light control. By analyzing the various sections of the refractor 18, it was found that light was "eluding" the poster panel in certain areas, in other words, it was going off into space in some unuseful direction often in the opposite direction from the poster panel. Normally, by straight refraction or bending of light, it is not possible to redirect light more than 45° to 50°. With this situation in mind, the Applicant's had to direct light that needed redirecting by angles of 100° to 120°. This problem was solved by the new and novel method utilized in the refractor of refraction, reflection and then refraction in one prismatic structure as shown in FIG. 10 of the drawing. Presuming that the direct ray of light emitted by the arc of the lamp 20 is at $A^0$ from nadir that hits the surface $S_1$ approximately normal (at a approximately right angles). The surface $S_1$ would be shown by the numeral 126 and the surface $S_2$ would be shown by the numeral 128 in FIG. 10. The surface $S_3$ would be shown by the numeral 130 which would represent the outside surface 46 of the refractor 18 as shown in FIG. 3 of the drawing. The $A_1$ ray, shown by 132 enters transparent medium (glass) without any significant change in its direction. Next, this $A_1$ ray hits surface $S_2$ of the prism. This $S_2$ surface is approximately vertically oriented and the ray in the glass hits the surface $S_2$ and reflects such that the angle of incidence "i", shown by the arrow 134 in respect to the normal to $S_2$ (label N $S_2$) is equal to the angle of reflection "r" shown by the arrow 136 as an angle in the glass G2. At surfaces $S_2$ total internal reflection in glass takes place because the angle of incidence (and angle of reflection) is greater than the critical angle.

The angle in the glass G2 represented by the numeral 138 then strikes the top surface of the refractor $S_3$ represented by the numeral 130 and is transmitted out and refracted in the process as the ray $A_2$ shown by the numeral 140. The ray $A_2$ is of such an angle that it strikes the poster panel in a location designed to improve the uniformity of light on the poster panel and to improve utilization of light on the sign. The angle $A_2$ depends upon the angle at which G2 strikes the normal to the surface $S_3$ and is calculable by Snells law governing refraction of light as it enters or leaves the media with varying indices of refraction. Air is approximately 1.0 index of refraction, and glass is approximately 1.5 index of refraction. Snell(s) law says that:

$$n_1 \text{ Sin}^{\circ}{}_1 = n_2 \text{ Sin}^{\circ}{}_2!$$

The $n_1$ and $n_2$ are the index of refraction of medium 1 and medium 2 respectively. It should be noted that $A_1$ does not have to be perpendicular to the surace $S_1$, but the whole prism structure, including the surface $S_1$ and surface $S_2$ must be so designed so that the exiting ray $A_2$ goes in the right direction. The closer $A_1$ is perpendicularly with $S_1$, the higher the efficiency of the prismatic structure.

Lateral control of the before described light control is accomplished by calculating the appropriate prism path or direction of proper lateral placement of the existing $A_2$ on the poster panel. Proper vertical placement of the light on the poster panel is accomplished by varying the depths of the prisms which, in effect, means varying the angle between the prism face $S_1$ and the prism face $S_2$.

It is felt that the Applicant's new and novel approach to redirecting the "hard to redirect light" by the prismatic structure on the refractor using three phase light control represents a novel approach to a difficult problem as presented by the poster panel size.

Referring now to FIG. 9 of the drawing there is shown a plan view of ½ of the Applicant's refractor 18. The plurality of prism elements will now be described and the process for redirecting the stray light resulting in the various sections shown in the FIG. 9 drawing will be seen. The section A prism is positioned approximately 38½° as shown by the angle 142 and the prism size would be approximately 2"×2" as shown by the numerals 144 and 146. In a similiar manner the prism section B would be positioned at an angle of approximately 29° as shown by the angle 148 in the drawings. The prism section B would also be sized approximately 2"×2" as shown by the numerals 144 and 150.

The prism section C would be angled approximately 14° as shown by the angle 152 and the prism section would be sized approximately 2"×2" as shown by the numerals 144 and 154. Prism section E would be angled approximately 35.5° as shown by the angle 156 and would also be sized approximately 2"×2" as shown by the numeral 158 and 146. The prism section D would be formed parallel to the front and rear edges of the refractor as shown in FIG. 9.

The prism section F would be angled approximately 16° as shown by the angle 160 and would also be sized approximately 2"×2" as shown by the numeral 158 and 150.

The prism section G and H would be positioned as shown in the drawing approximately parallel to the ends of the refractor mold and would also be sized approximately 2"×2" as shown by the numerals 158, 154 and 162.

Section I prisms would be angled approximately 15° as shown by the numeral 164 and that prism section would be sized approximately 2"×2" as shown by the numeral 146 and 166. The section K group of prisms and the P group of prisms are positioned approximately parallel to the front face of the mold as shown. The section K would be sized approximately 4"×7" as shown by the numerals 167 and 169. The section P would be sized approximately 2"×3.75" as shown by the numerals 166 and 171. The area shown by the numeral 170 may remain plain and unpolished as shown. Section L prisms would be formed approximately parallel to the front and rear edges of the refractor and would be approximately 5" long by 8" long as shown by the numerals 176 and 178. In a similar manner the section M group of prisms would be formed were shown in FIG. 9 of the drawing approximately parallel to the section L prisms and would be approximately 2½"×4" in size as shown by the numerals 180 and 182. The section Q prisms would be positioned as shown adjacent to the prism groups M, N and J.

A front wall grouping of prims section N would be formed as shown in the FIG. 9 drawing and a side section of prisms J would also be formed in the manner shown. The remaining portion of the side wall of the refractor would consist of section D prisms formed as designated on the drawing. A radial corner cut set of prisms shown by the numeral 184 fills in one pair of corners and the remaining wall section shown by the numeral 186 would be sandblasted to a heavy texture as is known in the art. A prism section O would be cut parallel to the line 175 as shown in FIG. 9.

The grouping of prisms section A, B, C, D, E, F, G and H are utilized for the stray light control and are designed for the three phase light control hereinbefore described consisting of refraction, reflection and refraction as related to FIG. 10 of the drawings. The other half of the refractor as shown in FIG. 9 would be a duplicate of FIG. 9 as shown.

Figure 11:
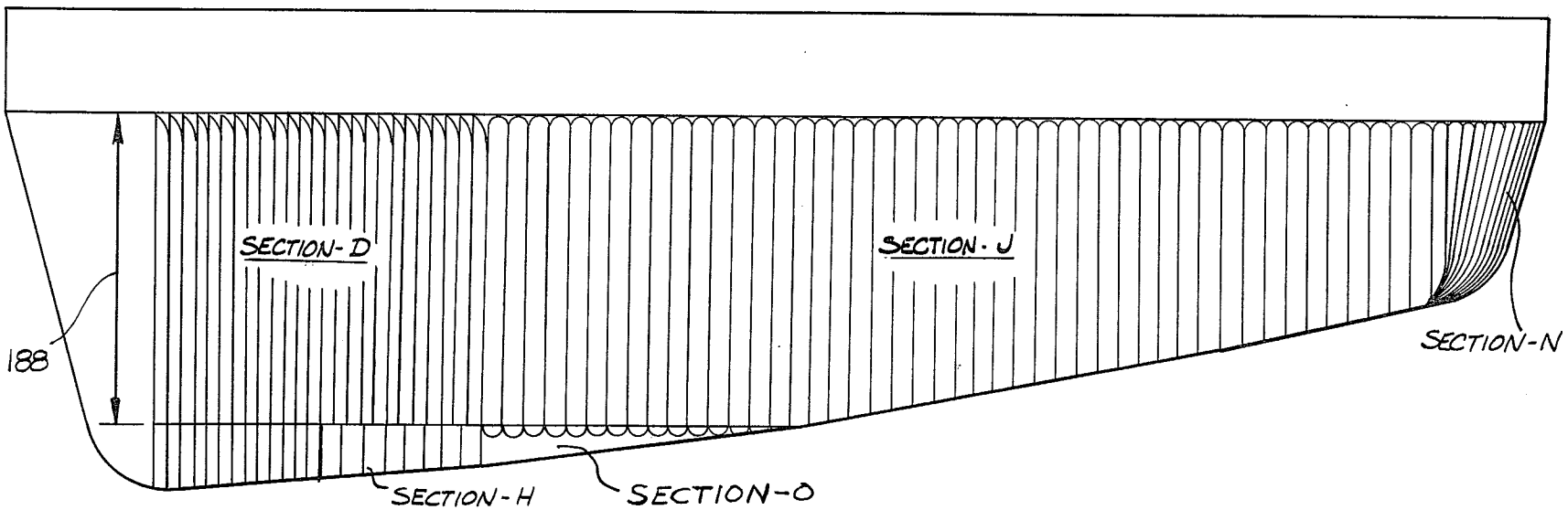
FIG. 11 is a side view, taken along line 11—11 of FIG. 9 showing the side Applicant's new and novel refractor.
Figure 12:
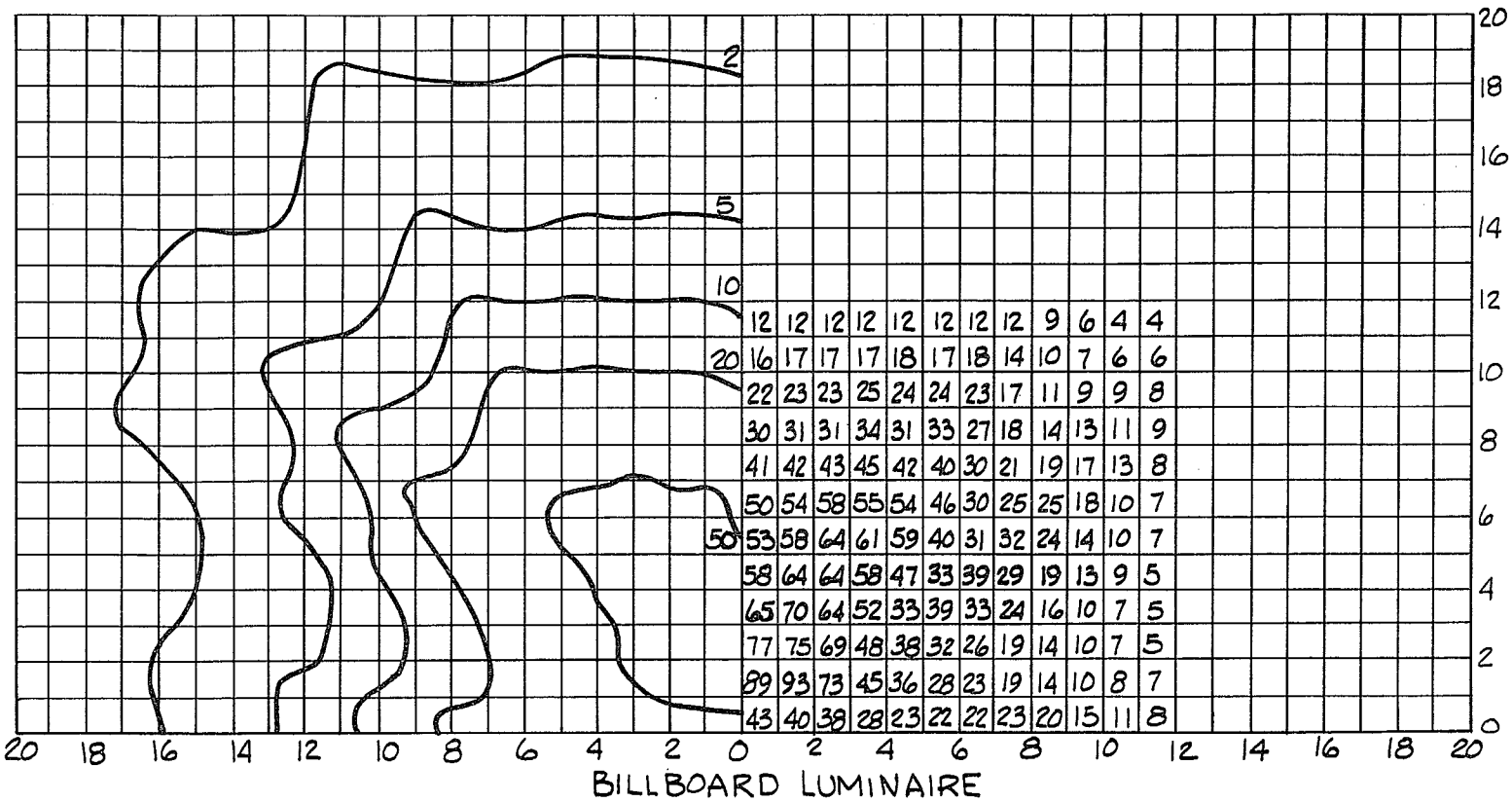
FIG. 12 is a chart, the right-hand side showing lumens in one foot square zones and the left side showing iso-footcandle lines (lines of equal illumination) developed by the Applicants' new and novel fixture.
Figure 13:
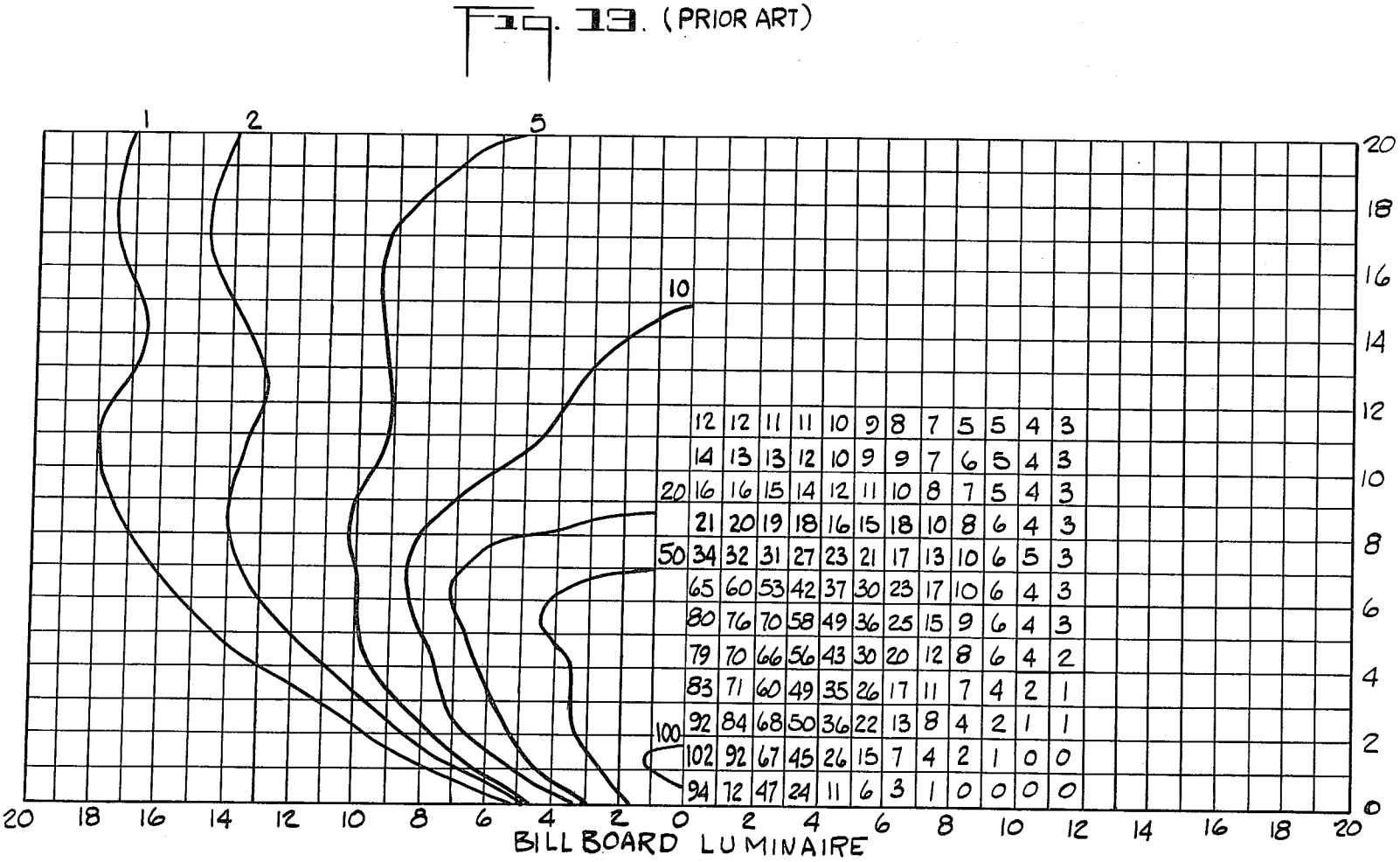
FIG. 13. (PRIOR ART)
FIG. 13 is a chart showing the performance of a prior-art type fixture hereinbefore using the same data presentation format.

Referring now to FIG. 11 of the drawing, there is shown a side view, taken along line 11—11 of FIG. 9, showing the plurality of prism elements positioned along the sides of the refractor 18. It can be seen in FIG. 11 how the section H prism elements run into the side surface adjacent to the section D prisms which also run into the upper surface as shown in FIG. 9. Adjacent to section D prisms would be a grouping of prism elements section J shown also in FIG. 9 which is utilized to smooth out light passing through that section of the prism. In the similiar manner section K shown in FIG. 9 is also used to smooth out light caused by imperfections in reflection or in the tooled surface of the refractor. Section L shown also in FIG. 9 is utilized primarily for directing the light downwardly on the front of the billboard panel. The height of the side prisms D and J would be approximately 3.8" as shown by the numeral 188. Referring now to FIG. 12 and FIG. 13 there is shown an analysis of the footcandles developed by the Applicant's new and novel lighting fixture in comparison to the footcandles developed by a prior art type fixture. The Applicant's fixture is shown in FIG. 12 of the drawing with a competitors' prior art fixture shown in FIG. 13. The Applicant's test data was taken from a test numbered 34,618 having the tested luminaire placed 4' out and 1' down from the bottom of the billboard structure. The competitors' data was taken from a test numbered 32,489 with the competitors' luminaire placed 4' out from the sign. The average foot candles for the Applicant's luminaire as shown in FIG. 12 was 28.5 in comparison to the competitors' average foot candle of 22. The Applicant's maximum foot candle was 94.12 as compared to the maximum foot candle of 102 for the competitor.

A minimum footcandle value of 4.37 was tested in the Applicant's luminaire with a minimum footcandle value of 0 in the competitors'. The maximum to minimum footcandle ratio of the Applicant's luminaire was 21.53 and the maximum to average ratio was 3.35 with the average to minimum ratio being 6.42. In distinction the maximum to minimum footcandle of the competitors' luminaire was 1830 with a maximum to average ratio of 5 and average to minimum ratio of 405. A perfect ratio would be 1 when comparing these numbers. From this it can be seen that the Applicant's luminaire with its new and novel features provides a more uniformally lighted billboard surface so that the sign placed upon the billboard surface would appear to be more uniformly lighted without great variations in luminance which is the light leaving the surface of the billboard.

From the forgoing it can be seen that there has been provided by the Applicant's new and novel invention a single lighting fixture which is capable of more evenly lighting a billboard panel of the type having a horizontal length approximately two times as long as its vertical length. The Applicant's device utilizes a combination of a high intensity discharge lamp positioned in a lamp housing with a new and novel reflector and refractor positioned within the housing to achieve the desired lighting in the various areas of the billboard. It should become apparent from a review of the application and a study of the drawings, that changes made be made in the arrangement of the parts and the structure and the parts of the Applicant's fixture without departing from the spirit scope of the invention and the Applicant's are not to be limited to the exact preferred embodiment shown which has been given by way of illustration only.

Having described our invention, we claim:

1. A lighting fixture for mounting in front of a large panel such as an advertising billboard and for illuminating the panel, the panel being of the type having a horizontal length approximately two times as long as its vertical length, comprising:

(a) a lamp housing;

(b) a generally horizontally positioned lamp contained within the lamp housing;

(c) means, attached to the lamp, for lighting the lamp;

(d) a reflector positioned on one side of the lamp and designed to reflect the light radiating from the lamp, the reflector having a first generally linear translated bottom parabolic surface and further having two side surfaces formed parabolic in one direction through a horizontal section of the side surface; and (e) a refractor, positioned on the lamp housing, to totally enclose the lamp from outside weather elements, the refractor comprising in part a combination of prism elements designed for three-phase light control of stray light and designed to refract, to reflect and finally to refract the stray light radiating from the lamp.

2. The lighting fixture as defined in claim 1, further comprising the lamp housing adapted to be horizontally positioned at the central portion of a billboard away from the billboard's surface.

3. A lighting fixture as defined in claim 1, further comprising a plurality of spherical protrusions being formed in the interior of the bottom reflector surface to eliminate radial streaks on a billboard surface.

4. The lighting fixture as defined in claim 1, further comprising the first bottom parabolic surface of the reflector positioned for lighting a central portion of a billboard and further comprising the two side surfaces of the reflector lighting generally triangular shaped corners of a billboard.

5. The lighting fixture as defined in claim 4, further comprising a plurality of bumps being formed on the interior of the reflector to eliminate radial streaks in a billboard between a central lighted portion and between generally triangular shaped corner portions.

6. The lighting fixture as defined in claim 5, further comprising a plurality of spherical protrusions formed in the reflector surface being formed as truncated spheres having a $+10°$ or $-10°$ slope giving a $+20°$ or $-20°$ light despersion on each side of the line between a central lighted portion of a billboard and two generally triangular shaped corner portions of the billboard.

7. A lighting fixture as defined in claim 1, further comprising the combination of prism elements on the refractor being positioned at the rear central portion and along each side of the refractor surface.

8. A lighting fixture as defined in claim 1, further comprising the outside surface of the refractor being formed as a generally smooth surface for self-cleaning purposes.

9. The lighting fixture as defined in claim 1, further comprising the lamp housing being positioned approximately three to four feet away from a billboard surface and further being positioned approximately one foot away from an elongated edge of the same billboard surface.

* * * * *